US009636683B2

(12) United States Patent
Tallent et al.

(10) Patent No.: US 9,636,683 B2
(45) Date of Patent: May 2, 2017

(54) RING FOR GRINDING MILL

(75) Inventors: Brian Tallent, Franklin, TN (US); Armond Groves, Nashville, TN (US)

(73) Assignee: Magotteaux International S.A., Vaux-sous-Chèvremont (BE)

( * ) Notice: Subject to any disclaimer, the term of this patent is extended or adjusted under 35 U.S.C. 154(b) by 651 days.

(21) Appl. No.: 13/637,477

(22) PCT Filed: Mar. 31, 2010

(86) PCT No.: PCT/EP2010/054278

§ 371 (c)(1),
(2), (4) Date: Feb. 6, 2013

(87) PCT Pub. No.: WO2011/120568

PCT Pub. Date: Oct. 6, 2011

(65) Prior Publication Data

US 2013/0126649 A1 May 23, 2013

(51) Int. Cl.
*B02C 15/00* (2006.01)
*B02C 15/02* (2006.01)

(52) U.S. Cl.
CPC ..... *B02C 15/003* (2013.01); *B02C 15/02* (2013.01)

(58) Field of Classification Search
CPC ..... B02C 15/003; B02C 15/02
USPC ..... 241/129, 131
See application file for complete search history.

(56) References Cited

U.S. PATENT DOCUMENTS 876,765 A * 1/1908 Besser ..... 241/129
1,526,618 A * 2/1925 Wickland ..... 241/60
1,573,191 A * 2/1926 Raymond et al. ..... 241/58
2,958,473 A * 11/1960 Massie ..... 241/108
3,337,142 A 8/1967 Williams
3,366,338 A 1/1968 Barton
4,022,387 A 5/1977 Williams
4,682,738 A * 7/1987 Chang ..... 241/56
4,874,135 A * 10/1989 Provost ..... B02C 15/001 241/103
5,054,697 A * 10/1991 Provost ..... B02C 15/001 241/119
5,238,196 A * 8/1993 Chang ..... 241/56
5,549,251 A * 8/1996 Provost ..... B02C 15/001 241/119
5,607,111 A * 3/1997 Brundiek ..... B02C 15/001 241/121
5,908,167 A * 6/1999 Provost ..... B02C 15/001 241/119
6,079,646 A * 6/2000 Keyssner ..... B02C 15/001 241/107
7,448,565 B2 * 11/2008 Farris ..... B02C 15/001 209/139.1
7,513,295 B2 4/2009 Poncin et al.
8,336,796 B2 * 12/2012 Wark ..... 241/119
(Continued)

FOREIGN PATENT DOCUMENTS

EP 1365863 A1 12/2003

*Primary Examiner* — Faye Francis

(74) *Attorney, Agent, or Firm* — Reinhart Boerner Van Deuren P.C.

(57) ABSTRACT

A segmented grinding ring for centrifugal vertical roller mills is provided. The segmented grinding ring includes multiple cast segments which may be vaulted together using pin rods and shims to form a continuous ring. The segmented grinding ring enables the manufacture of the segments in a cast composite material.

15 Claims, 4 Drawing Sheets

(56) References Cited

U.S. PATENT DOCUMENTS

| | | | | |
|---|---|---|---|---|
| 2002/0136857 | A1 | 9/2002 | Francois | |
| 2004/0046074 | A1 | 3/2004 | Soudron | |
| 2005/0016708 | A1 | 1/2005 | Herbst | |
| 2005/0072545 | A1 | 4/2005 | Poncin et al. | |
| 2008/0191077 | A1* | 8/2008 | Bentley | B02C 13/185<br>241/275 |
| 2009/0206186 | A1* | 8/2009 | Morrison et al. | 241/24.16 |

* cited by examiner

RING FOR GRINDING MILL

FIELD OF THE INVENTION

The present invention is related to a segmented grinding ring for centrifugal vertical roller grinding mills or pendulum grinding mills. In particular, the present invention relates to an improved segmented grinding ring with higher wear resistance.

STATE OF THE ART

The prior art discloses various grinding mill types. A typical configuration of a vertical roller centrifugal grinding mill comprising a grinding ring cooperating with a plurality of centrifugally operating grinding rollers is disclosed in the document U.S. Pat. No. 4,022,387 (see FIG. 1). To avoid extensive comments on how such a type of grinder works, this document is hereby incorporated by reference in the present description.

The document U.S. Pat. No. 3,337,142 discloses a roller grinding mill apparatus for comminuting solid materials such as mineral products, clays, coal or metal granules. This apparatus includes a monolithic annular grinding ring, a central rotating member and a plurality of rolls hung from the central rotating member and moved outwardly toward the grinding ring under the influence of centrifugal force. The grinding pressure can be adapted through the pressure of a liquid as well as through the rotational speed of the central member.

The document EP 1 365 863 A1 describes the same type of grinder.

The above-mentioned grinders comprise monolithic non-segmented grinding rings, which are manufactured in one piece and which are therefore difficult to replace. Furthermore, it is difficult to reinforce them against wear with very hard ceramic particles such as metallic oxides ($Al_2O_3$, $ZrO_2$, $Al2O_3$—$ZrO_2$ composites) or metallic carbides (WC, TiC, SiC), borides ($B_4C$) or nitrides (BN, $Si_3N_4$) in the manufacturing process. Monolithic grinding rings, once worn, are reinforced by cladding using carbides. This operation is nevertheless difficult and time consuming.

Ceramic particles have intrinsically different heat dilatation coefficients than iron-based cast metals and are therefore difficult to embed in metal matrixes without risk of tears due to differential cooling of the materials.

Specific reinforcement particles suitable to be used for a segmented grinding ring according to the present invention are disclosed in US RE 39,998. This document discloses a composite wear component produced by casting and consisting of a metal matrix whose working face or faces include inserts which have a very high wear resistance, said inserts consisting essentially of ceramic composites comprising 20 to 80% of $Al_2O_3$ and 80 to 20% of $ZrO_2$, the inserts being impregnated by liquid metal during the casting. This document is hereby incorporated by reference in the present description.

The documents U.S. Pat. No. 7,513,295 B2 and U.S. 2005/0072545 A1 disclose wear parts with reinforcing ceramic particles obtained by a self-propagating heat-synthesis (SHS) via inserts ignited and impregnated by the casting of the liquid metal. This type of technology can also be considered for the ceramic reinforcement of segmented grinding rings. This document is hereby incorporated by reference in the present description.

AIMS OF THE INVENTION

The present invention aims to provide a segmented grinding ring for grinding mills overcoming the drawbacks of the monolithic grinding rings of the prior art.

The present invention aims in particular to provide a segmented grinding ring making possible an individual replacement of each segment and reducing therefore substantially the downtime and the maintenance costs of a grinding mill comprising a segmented ring according to the invention.

The present invention aims further to provide a segmented grinding ring with an improved wear resistance and therefore a substantially higher lifetime.

SUMMARY OF THE INVENTION

The present invention discloses a segmented grinding ring for centrifugal vertical roller mills comprising a plurality of segments.

Preferred embodiments of the present invention comprise at least one, or an appropriate combination of the following features:

- the segments of the segmented grinding ring comprise a composite structure on their working face, said composite structure comprising ceramic particles embedded in a cast metal;
- the thickness of the composite structure comprising the embedded ceramic particles is at least 10 mm, preferably at least 20 mm;
- the thickness of the composite structure comprising the embedded ceramic particles is between 20 and 30 mm;
- the composite structure comprising the embedded ceramic particles is a honey comb structure;
- the ceramic particles are selected from the group consisting of metallic oxides, metallic carbides, borides and nitrides;
- the ceramic particles are selected from the group consisting of $Al_2O_3$, $ZrO_2$, $Al_2O_3$—$ZrO_2$, WC, TiC, SiC, $B_4C$, BN and $Si_3N_4$;
- the ceramic particles are spheroid ceramic grains of a size between 0.5 to 6 mm, said grains comprising an alumina-zirconia composite comprising 20 to 80 wt % $ZrO_2$ and 80 to 20 wt % $Al_2O_3$;
- the ceramic particles are spheroid ceramic grains of a size between 1 and 5 mm, said grains comprising an alumina-zirconia composite comprising 35 to 45 wt % $ZrO_2$ and 65 to 55 wt % $Al_2O_3$;
- the grinding ring presents 3 to 12 segments, preferably 4 to 6 segments;
- the segments comprise a recess for the introduction of a positioning pin located between each couple of segments, said segments being maintained connected to each other by vaulting effect;
- the segments comprise hangers to maintain the segments during the mounting operation;
- the ring comprises shims to close possible gaps between the segments after the mounting operation.

The present invention further discloses a centrifugal vertical roller mill comprising a segmented grinding ring according to the invention.

DETAILED DESCRIPTION OF THE INVENTION

Figure 1:
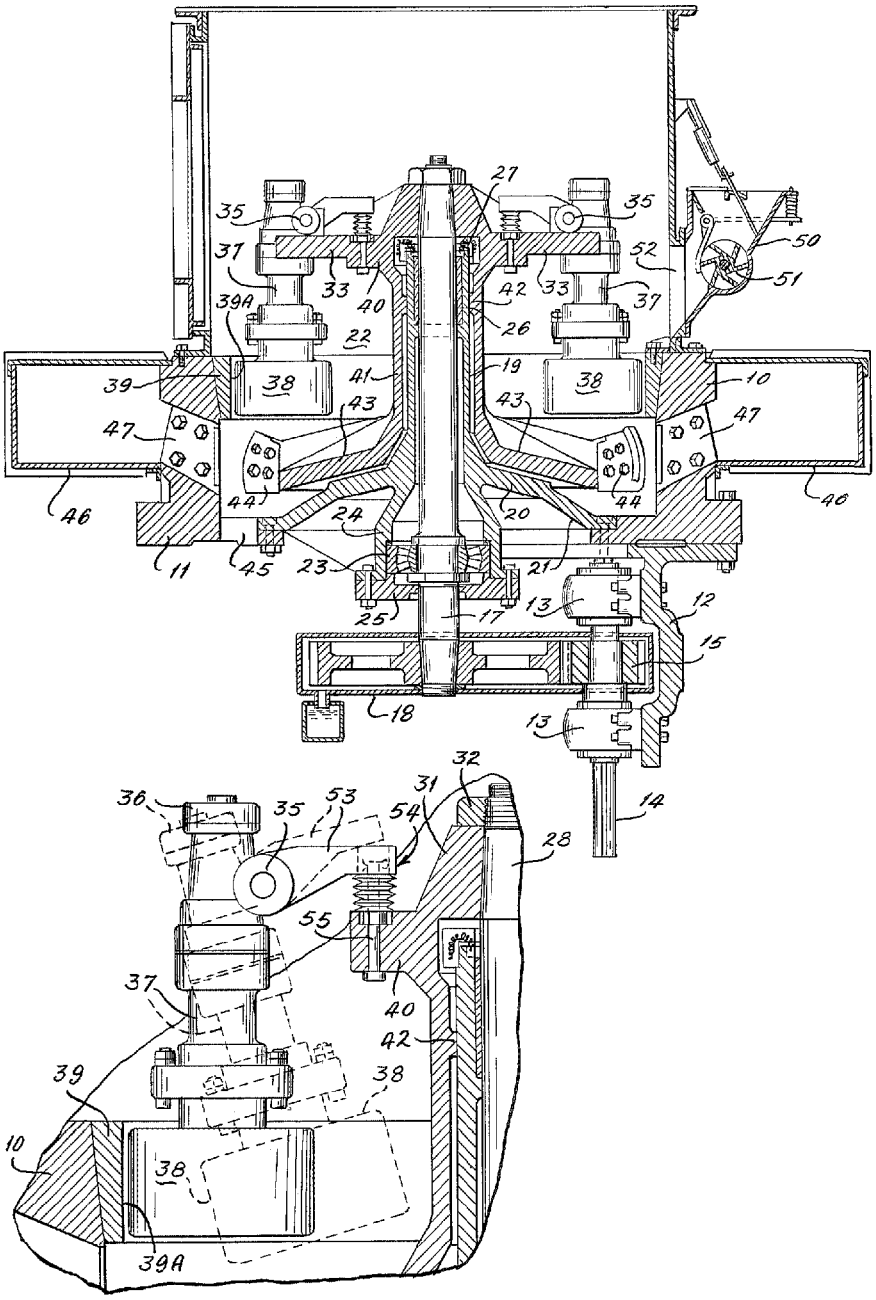
Fig. 1 Prior Art
FIG. 1 represents a roller grinding mill of the state of the art disclosed in U.S. Pat. No. 4,022,387, showing in which configuration a monolithic grinding ring (38) with its surface (39*a*) is arranged on a support (10) and cooperates with the centrifugal grinding rollers (10) for grinding operations.

The present invention is related to segmented grinding rings for vertical centrifugal mills. In this type of mills, also called pendulum roller mills, two or more rollers using centrifugal force grind various materials by rolling on a circular ring. This machine is frequently used to feed the coal burners of power plant stations.

The segmented grinding ring 100 of the present invention comprises multiple cast segments 102 which are vaulted together by vaulting effect using pin rods 104 and shims 106 to form a continuous ring 108. The number of segments varies generally between 3 and 12 and preferably between 4 and 10. The diameter of the assembled grinding ring 100 according to the invention is dependent on the type of the grinding mill and varies roughly between 1 and 4 meters, preferably between 1.5 and 3 meters. A segmented grinding ring enables the manufacturability of the segments 102 in a much harder cast material and in particular in composite material, which thus lengthens the lifetime and improves the performance of the grinding ring.

The casting of smaller pieces allows the embedding or the preparation in situ of hard ceramic particles such as, without being limitative, metallic oxides ($Al_2O_3$, $ZrO_2$, $Al_2O_3$—$ZrO_2$ composites) or metallic carbides (WC, TiC, SiC), borides ($B_4C$) or nitrides ($Si_3N_4$). To hold ceramic particles or a powder precursor of this particles (in the case of a SHS synthesis) in place, an insert of said particles is prepared and placed in the mould before the cast metal is poured on it. The cast metal impregnates the porous ceramic structure and builds a very wear resistant composite structure on the working side of the grinding ring segment.

This type of composite structure would be difficult to achieve on a monolithic grinding ring, because the casting as such is often too large and it is always difficult to hold a ceramic insert along a vertical surface when pouring the metal. Furthermore, on such a big monolithic block, the risk of tears/breakage during the metal solidification is too high with the risk of final rejection of the casting.

Additionally, the segmented ring according to the invention allows a substantial reduction of the downtime when replacing the ring, since it is not necessary anymore to remove the entire upper mill housing when installing or replacing the one-piece fabricated ring according to the prior art. An individual replacement of each segment becomes possible via the existing mill door (manhole).

The segmented ring according to the present invention offers in particular the advantages of supplying a grinding ring comprising reinforced working faces with high-performance wear-resistant composite material as compared to classical monolithic rings with weld overlay. This improves the lifetime of the ring by two or three, maintains the grinding profile much longer and thus improves the performance of the mill and reduces the operating and maintenance costs.

DESCRIPTION OF A PREFERRED EMBODIMENT OF THE INVENTION

Non-reinforced individual segments for the grinding ring of the present invention can be cast according to classical methods well known by those skilled in the art.

Figure 6:
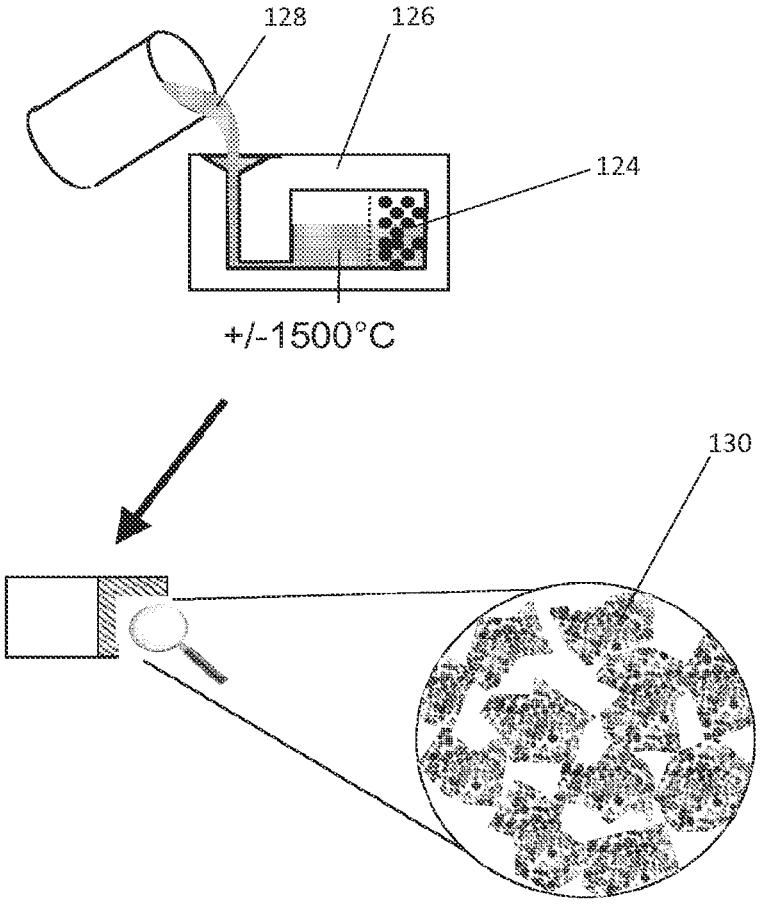
FIG. 6 represents the principle of the casting of a segment of the ring according to the invention with a reinforced part comprising an insert with ceramic particles or with a powder precursor of ceramic particles.

For the preparation of a reinforced individual segment for the grinding ring according to the invention, the working face 122 of the segment 102 is reinforced in depth with ceramic particles. The thickness of the reinforced layer 120 is generally higher than 10 mm, preferably higher than 20 mm and generally situated between 10 and 50 mm, preferably between 20 and 30 mm. Usually inserts of porous ceramic pads 124 of about 25 mm thickness are placed in the cast mould 126 on the working face 120 of a segment 102 followed by the pouring of iron-based cast metal 128 in the mould 126. The principle of this operation is represented in FIG. 6. The ceramic pad 124 is obtained by the agglomeration of ceramic granules 130 of a size between 0.5 and 6 mm, preferably between 1 and 5 mm. Such an agglomeration can occur in a press or with additional mineral glue. The ceramic pad can present any geometrical configuration, but it is always adapted to the depth of the working face 122 to be reinforced.

Figure 5:
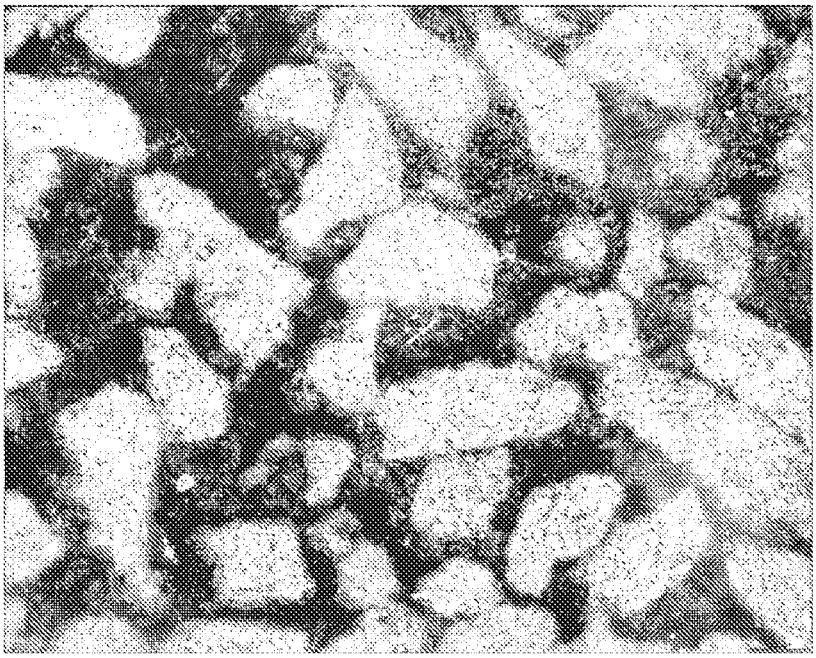
FIG. 5 represents a detailed section view of the reinforced part of the grinding ring with reinforcing ceramic particles embedded in the metal matrix.

During the cast operation, the ceramic insert is impregnated by the liquid cast metal and the ceramic particles are completely embedded in this way in the metal matrix. This impregnation leads to a substantially pore-free composite structure on the working face of the segment. Such a detailed structure is represented in FIG. 5.

Example

Figure 2:
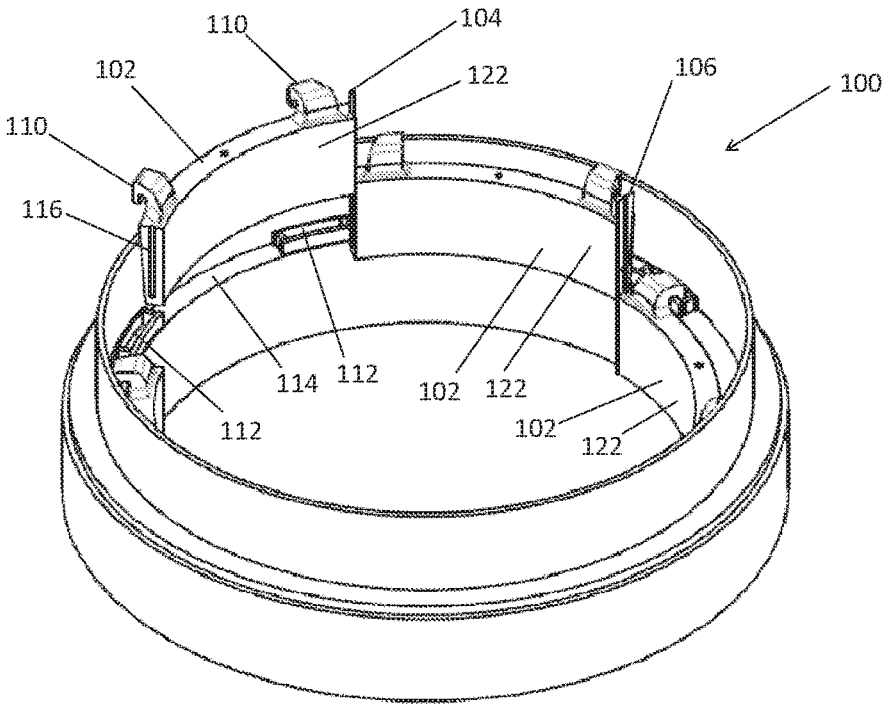
FIG. 2 represents a three-dimensional view of the segmented grinding ring, in this example with 6 segments, according to the invention.
Figure 3:
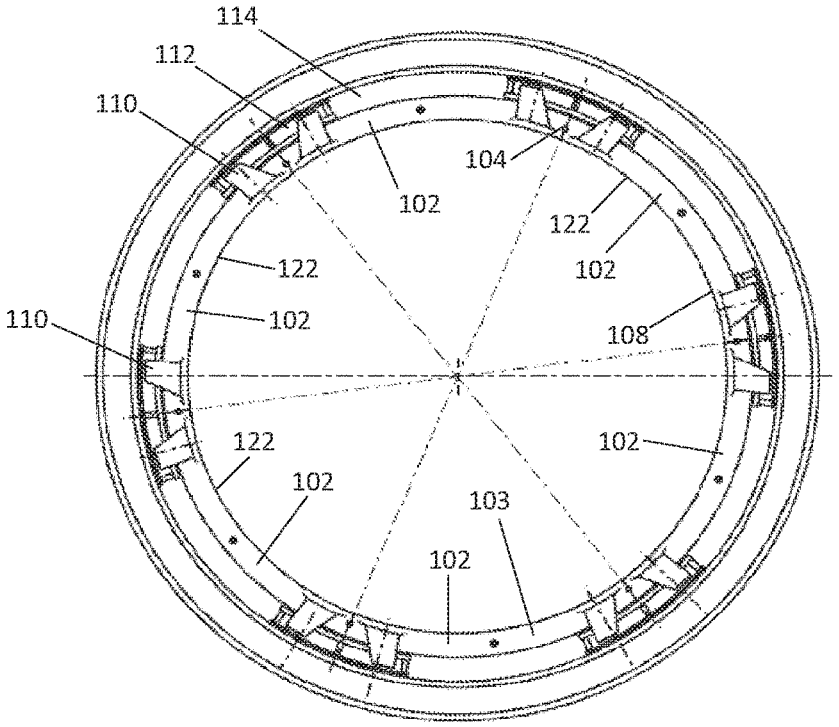
FIG. 3 represents a top view of the segmented grinding ring according to the invention.

A grinding ring with 6 segments and with a diameter of about 1.6 meters is assembled via pin rods and shims. Each segment comprises hangers 110 cooperating with specific holes in the supporting ring 114 of the grinding mill (see FIG. 2).

Each segment comprises in this case a reinforced composite wear layer of about 20 mm. The wear layer is reinforced by granules (0.5 to 5 mm) of a ceramic composite of alumina-zirconia (57 wt % Al2O3-43 wt % ZrO2) from which a compacted insert is placed in the mould before the segment is cast at about 1500° C.

Figure 4:
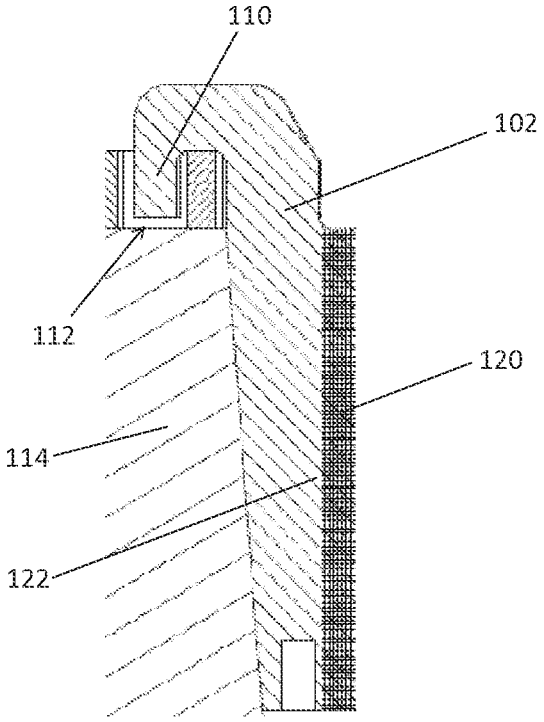
FIG. 4 represents a section view of the segmented grinding ring according to the invention with reinforcing ceramic particles (in grey).

The result of this pouring operation is represented in FIG. 4. A reinforced wear layer 120 of about 20 mm thickness is achieved on each individual segment 102.

After the casting of each of the six segments, a grinding ring 100 according to the invention is assembled. Each segment comprises a recess 116 for a positioning pin 104 to be placed between each couple of segments 102. This type of assembling allows maintaining the segments by vaulting effect.

The invention claimed is:

1. A centrifugal vertical roller mill, the vertical roller mill comprising:

a grinding ring assembly comprising:

a plurality of segments arranged to form an annular grinding cylinder, wherein each segment of said plurality of segments comprises a working face, wherein the working face of each segment of said plurality of segments is positioned radially inwardly on the annular grinding cylinder, each segment of the plurality of segments further comprising a recess for the introduction of a positioning pin located between each couple of segments, each segment of said plurality of segments further comprising hangers; and a plurality of pin rods, wherein a pin rod is positioned in the recess between each couple of segments, wherein the plurality of segments forms a continuous grinding ring, a supporting ring comprising holes cooperating with the hangers to support each segment of said plurality of segments; and a plurality of centrifugally operating grinding rollers.

2. The grinding ring assembly according to claim 1, wherein each segment of said plurality of segments comprise a composite structure on the working face, said composite structure comprising ceramic particles, and wherein said ceramic particles are embedded in a cast metal.

3. The grinding ring assembly according to claim 2, wherein a thickness of the composite structure comprising the ceramic particles is at least 10 mm.

4. The grinding ring assembly according to claim 2, wherein a thickness of the composite structure comprising the ceramic particles is between 20 and 30 mm.

5. The grinding ring assembly according to claim 2, wherein the composite structure comprising the ceramic particles is a honey comb structure.

6. The grinding ring assembly according to claim 2, wherein the ceramic particles are selected from the group consisting of metallic oxides, metallic carbides, borides and nitrides.

7. The grinding ring assembly according to claim 2, wherein the ceramic particles are selected from the group consisting of $Al_2O_3$, $ZrO_2$, $Al_2O_3$—$ZrO_2$, WC, TiC, SiC, $B_4C$, BN and $Si_3N_4$.

8. The grinding ring assembly according to claim 2, wherein the ceramic particles are spheroid ceramic grains of a size between 0.5 to 6 mm, said spheroid ceramic grains comprising an alumina-zirconia composite comprising 20 to 80 wt % $ZrO_2$ and 80 to 20 wt % $Al_2O_3$.

9. The grinding ring assembly according to claim 2, wherein the ceramic particles are spheroid ceramic grains of a size between 1 and 5 mm, said spheroid ceramic grains comprising an alumina-zirconia composite comprising 35 to 45 wt % $ZrO_2$ and 65 to 55 wt % $Al_2O_3$.

10. The grinding ring assembly according to claim 1, wherein said ring presents 3 to 12 segments.

11. The grinding ring assembly according to claim 1, wherein the hangers are operable to cooperate with mounting holes in a cylindrical supporting ring.

12. The grinding ring assembly according to claim 1, wherein said cylindrical grinding ring comprises shims between the segments.

13. The grinding ring assembly according to claim 1, wherein the hangers of each segment of said plurality of segments cooperate with specific holes in the supporting ring.

14. The grinding ring assembly according to claim 1, wherein each segment of said plurality of segments maintained in the continuous grinding ring by a vaulting effect by introduction of a positioning pin located between each couple of segments.

15. The grinding ring assembly of claim 1, wherein the recess between each couple of segments does not contact the working face of each segment of said plurality of segments.

* * * * *